US006737102B1

(12) United States Patent
Saidman et al.

(10) Patent No.: US 6,737,102 B1
(45) Date of Patent: May 18, 2004

(54) APPARATUS AND METHODS FOR APPLYING VISCOUS MATERIAL IN A PATTERN ONTO ONE OR MORE MOVING STRANDS

(75) Inventors: Laurence B. Saidman, Duluth, GA (US); David Zgonc, Atlanta, GA (US); Patrick L. Crane, Dawsonville, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/284,972

(22) Filed: Oct. 31, 2002

(51) Int. Cl.[7] ..... B05D 1/30; B05D 5/10

(52) U.S. Cl. ..... 427/8; 427/208; 427/208.6; 427/286

(58) Field of Search ..... 427/8–10, 207.1–208.8, 427/286; 118/665, 667–669, 672, 690, 691, 712

(56) References Cited

U.S. PATENT DOCUMENTS

| | | | | |
|---|---|---|---|---|
| 3,956,630 A | | 5/1976 | Mellows | 250/302 |
| 4,778,999 A | | 10/1988 | Fisher | 250/461.1 |
| 4,785,996 A | | 11/1988 | Ziecker et al. | 239/298 |
| 4,844,003 A | | 7/1989 | Slautterback et al. | 118/323 |
| 4,960,619 A | | 10/1990 | Slautterback et al. | 427/265 |
| 5,026,989 A | | 6/1991 | Merkel | 250/338.1 |
| 5,030,833 A | | 7/1991 | Nozaka et al. | 250/461.1 |
| 5,208,064 A | * | 5/1993 | Becker et al. | |
| 5,322,706 A | | 6/1994 | Merkel et al. | 427/8 |
| 5,323,005 A | | 6/1994 | Merkel | 250/338.1 |
| 5,507,909 A | | 4/1996 | Rollins et al. | 156/425 |
| 5,582,663 A | | 12/1996 | Matsunaga | 156/64 |
| 5,666,325 A | | 9/1997 | Belser et al. | 367/95 |
| 6,077,375 A | * | 6/2000 | Kwok | |
| 6,197,406 B1 | | 3/2001 | Kwok | 428/195 |
| 6,200,635 B1 | | 3/2001 | Kwok | 427/286 |
| 6,224,699 B1 | * | 5/2001 | Bett et al. | |
| 6,235,137 B1 | | 5/2001 | Van Eperen et al. | 156/176 |
| 6,342,264 B1 | | 1/2002 | Raterman et al. | 427/8 |
| 6,361,634 B1 | | 3/2002 | White et al. | 156/161 |
| 6,461,430 B1 | | 10/2002 | Kwok | 118/325 |

* cited by examiner

*Primary Examiner*—Fred J. Parker
(74) *Attorney, Agent, or Firm*—Wodd, Herron & Evans, L.L.P.

(57) ABSTRACT

Apparatus and methods for monitoring the application of a viscous material onto at least one moving strand or other narrow substrates. A detection unit, such as a machine vision system, an infrared sensor, an ultraviolet detector, or a light curtain with multiple detectors, senses radiation originating from the viscous material after it is applied to the strand or strands and, typically, before each strand is contacted with a substrate. The detection unit determines a detected value representative of a characteristic of the pattern from the sensed radiation, compares the detected value with a reference value representative of a desired standard for the characteristic, and outputs a signal in accordance with the result of the comparison.

24 Claims, 4 Drawing Sheets

APPARATUS AND METHODS FOR APPLYING VISCOUS MATERIAL IN A PATTERN ONTO ONE OR MORE MOVING STRANDS

FIELD OF THE INVENTION

The present invention generally relates to a liquid material dispensing apparatus and methods and, more specifically, to apparatus and methods for monitoring the quality-of the application of patterned viscous material onto moving strands.

BACKGROUND OF THE INVENTION

In various types of manufacturing operations, it is necessary to bond narrow substrates, such as thin elastic strands, with a wider substrate, such as one or more sheets of material. Fiberized adhesives, including temperature and/or pressure sensitive adhesives, are commonly dispensed onto woven and nonwoven flat substrates and stretched elastic strands during the manufacture of hygienic articles, such as diapers, incontinence pads and other absorbent undergarments. For manufacturing such hygienic articles, small volumes of adhesive may be dispensed onto one or more individual elastic strands simultaneously, either before or after the strand has been laid against a substrate, to bond each strand to the substrate. In this manner, overlapping portions of the same material may be bonded together with stretched elastic strands secured therebetween or two distinctly different substrates may be bonded together as a laminate with stretched elastic strands secured therebetween. This is a popular manufacturing technique for elasticizing specific areas of hygienic articles, such as the waistbands, leg cuffs, and standing leg gathers of diapers and adult incontinence products.

One type of coating applicator or adhesive dispenser that has been used extensively for bonding one or more elastic strands to one or more flat substrates is CONTROLLED FIBERIZATION™ (CF™) technology, which is described, for example, in U.S. Pat. No. 4,785,996. This familiar adhesive dispensing technique impacts a dispensed continuous filament of adhesive with air jets to impart a swirl to the adhesive filament transverse to the direction of movement of a strand receiving the adhesive filament. In this manner or a similar manner, the continuous adhesive filament may be dispensed in any pattern onto an individual elastic strand while the strand is moving and separated from the substrate. The adhesive filament wraps itself around each elastic strand before the strand contacts the substrate, which strengthens the adhesive bond between the elastic strand and substrate. Other conventional adhesive filament dispensing techniques and apparatus have been employed for producing patterns of adhesive on an elastic strand, such as vascillating patterns disclosed in U.S. Pat. No. 6,077,375 and omega-shaped patterns as disclosed in U.S. Pat. Nos. 6,461,430, 6,200,635 and 6,197,406.

Another adhesive dispensing technique for securing elastic strands to a substrate relies upon dispensing discrete areas of an adhesive onto moving strands while the strands are separated from the substrate. For example, the discrete areas may define a repeating pattern consisting of solid dots of adhesive, which may or may not be interconnected by thinner intervening filament sections.

Generally, the dispensing of adhesives onto a substrate may be monitored either visually or through the use of various types of conventional infrared and ultraviolet sensors. For example, infrared sensors may be employed for monitoring infrared radiation emitted from adhesive residing on the substrate. As another example, the fluorescence in the visual region of the electromagnetic spectrum from the adhesive residing on the substrate may be monitored when the adhesive is illuminated by ultraviolet radiation.

A persistent problem characterizing the application of a patterned adhesive onto an elastic strand is an inability to determine whether or not the pattern is being properly applied to each elastic strand before the strands are applied to the substrate. Improper application may arise from, for example, excessive movement or motion of the parent machine with which the adhesive dispenser is attached, misalignment of the dispensed adhesive relative to the moving elastic strand, or clogging of one or more of the individual dispenser adhesive discharge outlets or air jets. If improper application is undetected, defective hygienic articles may be produced with a resulting loss of usable product yield.

Conventional methods for monitoring the dispensing of adhesive onto substrates are inadequate for sensing the presence or absence of a pattern applied to an elastic strand. Elastic strands typically have a diameter in the range of about 15 mils to about 20 mils. The addition of the adhesive to the strand increases the effective diameter of the strands. However, a machine operator may not be able to sense the presence or absence of adhesive with the naked eye.

Conventional monitoring techniques lack the sensitivity for accurately determining the presence or absence of adhesive from observation of the strand and adhesive after contact is established with the substrate. Such monitoring techniques, otherwise capable of observing large amounts of adhesive residing on a substrate, are not well suited for monitoring the application of a small-volume pattern of adhesive to a strand. In particular, such techniques are not effective for observing a small-volume pattern of adhesive applied to a strand moving at high line speeds as great as 1200 feet per minute. The adhesive residing on the strand is a small portion of the much larger substrate and, therefore, is difficult to distinguish from the material forming substrate. The substrate and adhesive are also typically formed from similar materials, usually polymeric resins, which increases the difficulty of distinguishing the adhesive from the substrate. Sensors used in conventional monitoring techniques typically monitor an absolute level of adhesive. Generally, such sensors may experience drift during operation that may erroneously indicate a problem with the adhesive dispensing.

Even if the pattern of adhesive is successfully applied to an elastic strand, it is critical in the manufacture of certain hygienic articles to monitor whether or not the applied amount is correct or within an acceptable range. In addition to being securely bonded to the substrate, the elastic strands must also transfer the desired elastic properties to the substrate. If the amount of adhesive on a strand is deficient, the strand may not be adequately bonded to the substrate. If the amount of adhesive on one or more strands exceeds a targeted volume, the adhesive application process loses cost effectiveness since more adhesive is being applied than is required to provide an adequate bond. In addition, the elastic properties of the bonded elastic strand or strands and substrate, such as product flexibility and the formation of rugosities when the stretched strands relax, may be degraded by the presence of excessive adhesive.

For these and other reasons, it would be desirable to provide apparatus and methods for monitoring the application of a viscous material, such as an adhesive, in a pattern to one or more strands.

SUMMARY OF THE INVENTION

The invention provides an apparatus for applying an adhesive in a pattern onto a moving strand, or other relatively narrow substrates, for subsequently securing the strand to a substrate. The apparatus includes a coating applicator capable of applying viscous material in a pattern onto the moving strand and a detection unit capable of sensing radiation originating from at least the viscous material. The detection unit is further capable of determining a detected value representative of a characteristic of the pattern from the sensed radiation, comparing the detected value with a reference value representative of a desired standard for the characteristic, and outputting a signal in accordance with the comparison result. The characteristic may be used to determine the presence or absence of the adhesive filament, or may be used to determine whether a proper volume of adhesive is being applied.

In one specific embodiment of the apparatus of the invention, the detection unit is a machine vision system including a camera and a controller. The camera is capable of capturing an image of the strand and viscous material. The controller is capable of determining a detected value representative of a characteristic of the pattern from the image, comparing the detected value with a reference value representative of a desired standard for the characteristic, and outputting a signal in accordance with the comparison result.

According to the principles of the invention, a method is provided for applying a viscous material onto a moving strand for securing the strand to a substrate. The method includes moving the strand in a travel path, applying a viscous material in a pattern onto the moving strand, sensing radiation originating from at least the viscous material, and determining a detected value representative of a characteristic of the pattern from the sensed radiation. The method further includes comparing the detected value with a reference value representative of a desired standard for the characteristic and outputting a signal in accordance with the comparison result.

In one specific embodiment of the method of the invention, the sensing of radiation further comprises capturing an image of the strand, and determining of the detected value further comprises processing the captured image. The image processing may further include determining the volume of adhesive in the pattern, which permits a determination of whether or not a proper amount of adhesive is contained in the adhesive filament being applied to the strand.

According to the principles of the invention, detecting a characteristic of the adhesive pattern, before the strand is applied to a substrate, increases the sensitivity and reliability of adhesive monitoring. In particular, the adhesive filament is easier to perceive before the strand is applied to the much larger substrate. Therefore, the pattern of adhesive may be applied to the moving strand with an improved consistency. In particular, the sensitivity and reliability of the monitoring is significantly improved for strands moving with high speeds. Moreover, the ability to monitor the application of the adhesive pattern reduces waste adhesive arising from improper application and reduces the likelihood of lost usable product yield. The principles of the invention also provide predictive maintenance possibilities.

These and other features, objects and advantages of the invention will become more readily apparent to those of ordinary skill in the art upon review of the following detailed description, taken in conjunction with the accompanying drawings.

DETAILED DESCRIPTION OF PREFERRED EMBODIMENTS

Although the invention will be described next in connection with certain embodiments, the invention is not limited to practice in any one specific type of system for dispensing viscous material in a pattern onto a strand or other narrow substrate, such as an elongated member or an optical fiber. It is contemplated that the invention can be used with a variety of such dispensing systems, including but not limited to adhesive dispensing systems configured to apply patterns of adhesive to a stretched elastic strand during the manufacture of hygienic articles. Exemplary dispensing systems in which the principles of the invention can be used are commercially available, for example, from Nordson Corporation (Westlake, Ohio) and such commercially available dispensing systems may be adapted for monitoring the application process in accordance with the principles of the invention. The description of the invention is intended to cover all alternatives, modifications, and equivalent arrangements as may be included within the spirit and scope of the invention as defined by the appended claims. In particular, those skilled in the art will recognize that the components of the invention described herein could be arranged in multiple different ways.

Figure 1:
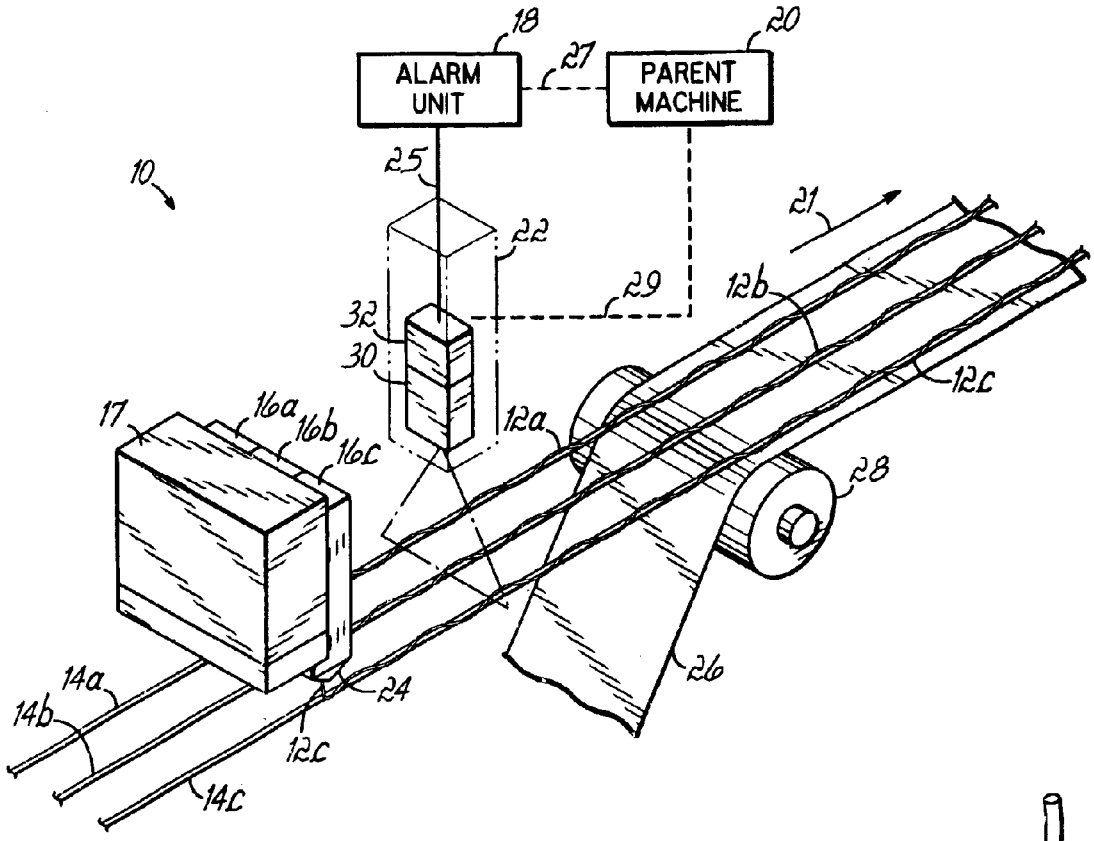
FIG. 1 is a schematic view of a coating application system according to the principles of the invention.

Referring to FIG. 1, an exemplary coating application system, indicated generally by reference numeral 10, is provided which is capable of applying viscous material, such as an adhesive or a heated adhesive, in a pattern onto one or more moving elongate members or strands moved along a travel path by a parent machine 20. The coating application system 10 generally includes one or more coating applicators or dispensing modules and, in this embodiment, three dispensing modules 16*a*, 16*b* and 16*c* each capable of dispensing viscous material, illustrated as but not limited to filaments 12*a*, 12*b*, and 12*c*, respectively, onto a corresponding one of three strands 14*a*, 14*b*, and 14*c*. A manifold 17 supplies viscous material, which may be heated, to each of the dispensing modules 16*a–c* and may also provide process air, which may also be heated. The parent machine 20 causes the strands 14*a–c* to be unwound, for example, from a bulk reel or spool (not shown) and, thereafter, causes the strands 14*a–c* to move in a machine direction or filament travel direction 21 that eventually contacts the strands 14*a–c* with a substrate 26, such as a woven or non-woven web.

The strands 14*a–c* are transported past the dispenser modules 16*a–c* so that each of the strands 14*a–c* is located proximate to a discharge outlet 24 of the corresponding one of the dispensing modules 16*a–c*. Discharge outlet 24 may be circular, elongate, slot-shaped, or other geometrical shapes suitable for dispensing filaments 12*a–c* of a desired width and with a pattern as discussed in greater detail herein. The discharge outlet 24 of each of the dispensing modules 16*a–c* is spaced a short distance apart from the respective strands 14*a–c*.

Dispensing modules 16*a–c* generally comprise any dispensing module capable of applying viscous material in a pattern, either regular or irregular in nature, onto a moving strand, including those that rely upon pressurized process air or other manners of displacing a continuous filament after discharge and those that periodically interrupt the flow of viscous material to generate an intermittent pattern. Each of the dispensing modules 16*a–c* applies one of the filaments 12*a–c* in a pattern onto a corresponding one of the strands 14*a–c*.

Figure 2:
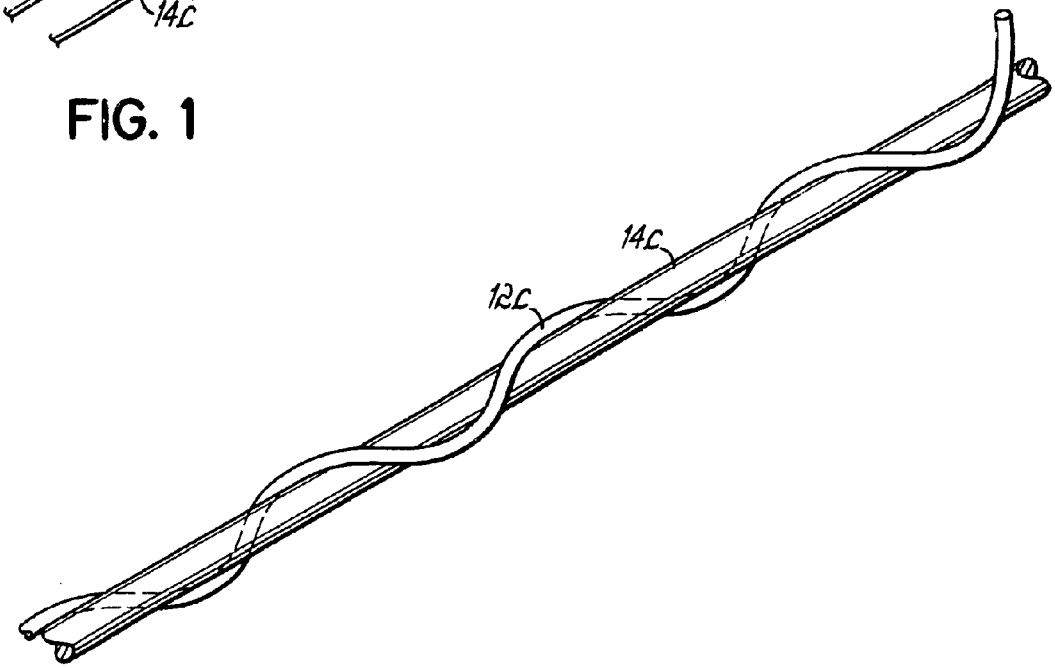
FIG. 2 is an enlarged schematic view of a portion of FIG. 1 showing a filament after application to a strand.

With reference to FIG. 2, each of the filaments 12*a–c* and, for example, filament 12*c* is applied with a pattern, relative to filament travel direction 21, having a statistically-averaged frequency or period, although the invention is not so limited. The pattern may be any pattern, either regular or irregular in nature, including but not limited to swirl patterns, vacillating patterns, generally sinusoidal patterns with curvilinear segments, non-sinusoidal curvilinear patterns, sawtooth or zig-zag patterns, and other back-and-forth patterns. The pattern may have either a regular or irregular period, as periodicity is not required. It is appreciated that the dispensing modules 16*a–c* may discharge viscous material in a pattern that develops into discrete areas defining a pattern of solid dots, which may or may not be interconnected by thinner intervening filament sections, and which may be either irregular or regular in nature. The pattern of the solid dots may have a regular or irregular period, as periodicity is not required.

With renewed reference to FIG. 1, filaments 12*a–c* are discharged from a corresponding one of the dispensing modules 16*a–c* in a pattern onto one of the strands 14*a–c* upstream from the point where the strands 14*a–c* meet the substrate 26. The strands 14*a–c* are applied to the substrate 26 at a nip roller station 28 downstream of the dispensing modules 16*a–c* and may be secured to substrate 26 by the respective filaments 12*a–c*. To that end, the strands 14*a–c* and the substrate 26 are moved in a converging manner from a first position in which the strands 14*a–c* are spaced from the substrate 26 to a second position in which the strands 14*a–c* contact one surface of the substrate 26 for securing the strands 14*a–c* to the substrate 26.

The alarm unit 18 is interfaced with the detection unit 22 by a line 25. The alarm unit 18, in the event of improper or failed viscous material application onto one or more of the strands 14*a–c*, may include a visual indicator or an audible indicator, and/or may be interfaced with the parent machine 20 by a cable 27 for providing a deactivation signal to halt the production line. The detection unit 22 triggers operation of the alarm unit 18, as described herein.

Detection unit 22 is positioned at a location between the dispensing modules 16*a–c* and the nip roller 28 that applies the strands 14*a–c* to the substrate 26. The detection unit 22 is a machine vision system that incorporates a camera 30, such as a CCD camera, and a controller 32 coupled in electrical communication with camera 30. Camera 30 is mounted with a static or fixed field of view of a reference area in space that encompasses at least a portion of strands 14*a–c* downstream of the dispenser modules 16*a–c* and before the strands 14*a–c* are contacted with the substrate 26 by the nip roller 28. Camera 30 is configured for capturing a series of images 31 (FIG. 2A) of objects within the reference area. The image 31 is an array, usually a rectangular matrix, of pixels in which each pixel represents a grayscale intensity value. Among the machine vision systems suitable for use as detection unit 22 in the invention are the Series 500 and the Series 600 imaging sensors commercially available from DVT Corporaton (Norcross, Ga).

Figure 2A:
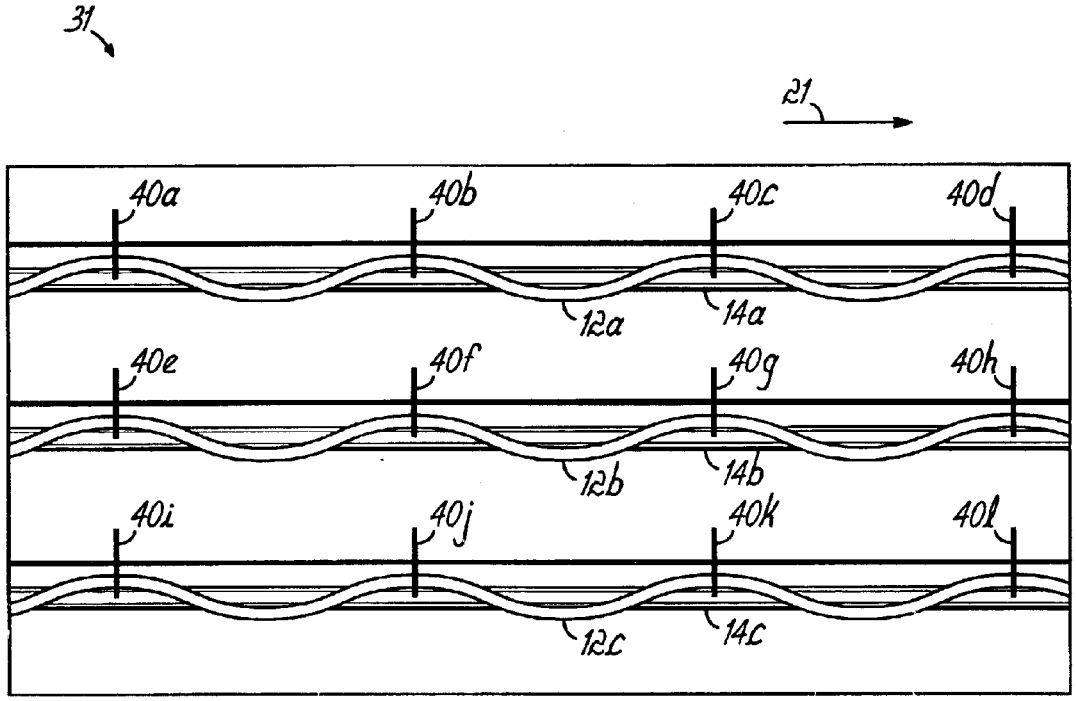
FIG. 2A is a schematic view of an image of a filament applied to a strand.

With reference to FIG. 2A, controller 32 implements software to perform image processing of the captured image 31 received from camera 30. Specifically, controller 32 processes the captured image 31 to determine a detected value of a characteristic of the pattern created by the filaments 12*a–c*. The characteristic may be any suitable property relating to the pattern and, in certain embodiments, may relate to repetitive features present in the pattern. For example, the controller 32 may calculate an average intensity level of the captured image 31, or a portion of the captured image 31, as a characteristic of the pattern. As another example, the controller 32 may perform an object/shape-based analysis of one or more of the filaments 12*a–c* visible in the captured image 31 to determine a characteristic, such as average period, of repetitive features in the corresponding pattern.

Generally, the presence of the filaments 12*a–c* on the corresponding strands 14*a–c* increases the average intensity level of captured images 31 because a larger percentage of the pixels in image 31 have larger grayscale intensity values. In addition, the pattern of each of the filaments 12*a–c*, when applied to the corresponding one of the strands 14*a–c*, may define one or more repetitive or identifiable features that are discerned, perceived from, or otherwise visible in the captured image 31. In particular, filament 12*a* defines a plurality of, for example, four repetitive features 40*a–d* on strand 14*a*, filament 12*b* defines a plurality of, for example, four repetitive features 40*e–h* on strand 14*b*, and filament 12*c* defines a plurality of, for example, four repetitive features 40*i–l* on strand 14*c*. The period or frequency associated with, for example, filament 12*a* is determined by counting and calculating, by a statistical analysis, a detected number of repetitive features 40*a–d* per unit length of the strand 14*a*. It is appreciated that the illustrated patterns on strands 14*a–c* are not limiting and that the pattern of filaments 12*a–c* may be any pattern, regular or irregular in nature, having discernable or perceivable repetitive features with a period or frequency as described herein. For example, the analysis of patterns having solid dots may provide, for example, perceivable features of increased grayscale intensity value or brightness, which may be repetitive and may have a period defined by a number of detected dots per unit length.

The controller 32 compares the detected value of the characteristic with a stored reference value representative of a desired standard for the characteristic. For example, the reference value may be established by analyzing a set of captured images 31 to determine the reference value or may be empirically determined by observation. The comparison may determine the absence of one or more of the filaments 12*a–c* due to, for example, positional misalignment between the absent filament(s) and its corresponding strand(s) or, in the alternative, may determine the volume of viscous material in the dispensed pattern of one or more of the filaments 12*a–c*. If the comparison indicates that the detected value representative of, for example, the average intensity level or the period of the repetitive features is below a threshold, exceeds a limit, or is outside of a range of values, the controller 32 of detection unit 22 transmits an alarm signal via line 25 to the alarm unit 18. It is contemplated by the invention that information from the detection unit 22 may be used for controlling operating parameters of dispensing modules 16*a–c*.

The comparison between the stored reference value of the characteristic and the detected value of the characteristic monitors changes on a dynamic signal. Therefore, monitoring, for example, the repetitive features 40*a–l* to dynamically sense changes on a signal level is more reliable and provides greater sensitivity than conventional techniques that sense absolute signal levels and that are influenced by drift. In particular, sensing changes in a value of a characteristic is more reliable and more sensitive for detecting viscous material applied with a pattern to strands moving at a high speed relative to a detection unit.

The pattern of the filaments 12*a–c* coating the respective strands 14*a–c* also provides a characteristic manifested by increases, irregularities or variations in the strand diameter. Accordingly, the controller 32 of detection unit 22 may process the captured image 31 to determine an effective average strand diameter for each strands 14*a–c* and the corresponding one of filaments 12*a–c*. Deviations in strand diameter outside of one or more limits or thresholds, or relative to one or more reference diameter values, may indicate the absence of one of the corresponding filaments 12*a–c*, if the average diameter is too small, or an excessive amount of viscous material being applied to one of the strands 14*a–c*, if the average diameter is too large.

In use and with reference to FIGS. 1 and 2A, the strands 14*a–c* are moved in the filament travel direction 21 past the dispenser modules 16*a–c* each of which dispenses a corresponding filament 12*a–c*. The filaments 12*a–c* contact a corresponding one of the strands 14*a–c* with a pattern typically imparted by the dispenser modules 16*a–c*. The strands 14*a–c* are moved past the field of view of camera 30, which 'serially captures images 31 of the filaments 12*a–c* and strands 14*a–c* either continuously at the camera frame rate or at fixed temporal intervals. The camera 30 performs, for example, an object/shape-based analysis of repetitive features 40*a–l* to determine whether or not each of the filaments 12*a–c* is present on the corresponding one of strands 14*a–c*. Alternatively, and as, another example, the controller 32 of the detection unit 22 may compare the intensity level of the strand diameter with a reference intensity level of the strand diameter for monitoring the application of filaments 12*a–c* to strands 14*a–c*.

If one or more of the filaments 12*a–c* is missing from the corresponding one of strands 14*a–c* or if the amount of viscous material in one or more of the filaments 12*a–c* is outside of tolerance limits, the controller 32 provides a fault signal via line 25 to the alarm unit 18, which indicates a fault condition. Alternatively, the controller 32 may discontinue the provision of an electrical signal via line 25 to alarm unit 18 that, if uninterrupted, indicates proper application. The alarm unit 18 can provide an audible or visible alert to an observer, and/or may issue a deactivation signal to parent machine 20 via line 27 for halting the production line. It is contemplated by the invention that any fault signal issued by the controller 32 may berouted directly via line 29 as a deactivation signal to the parent machine 20.

Figure 3:
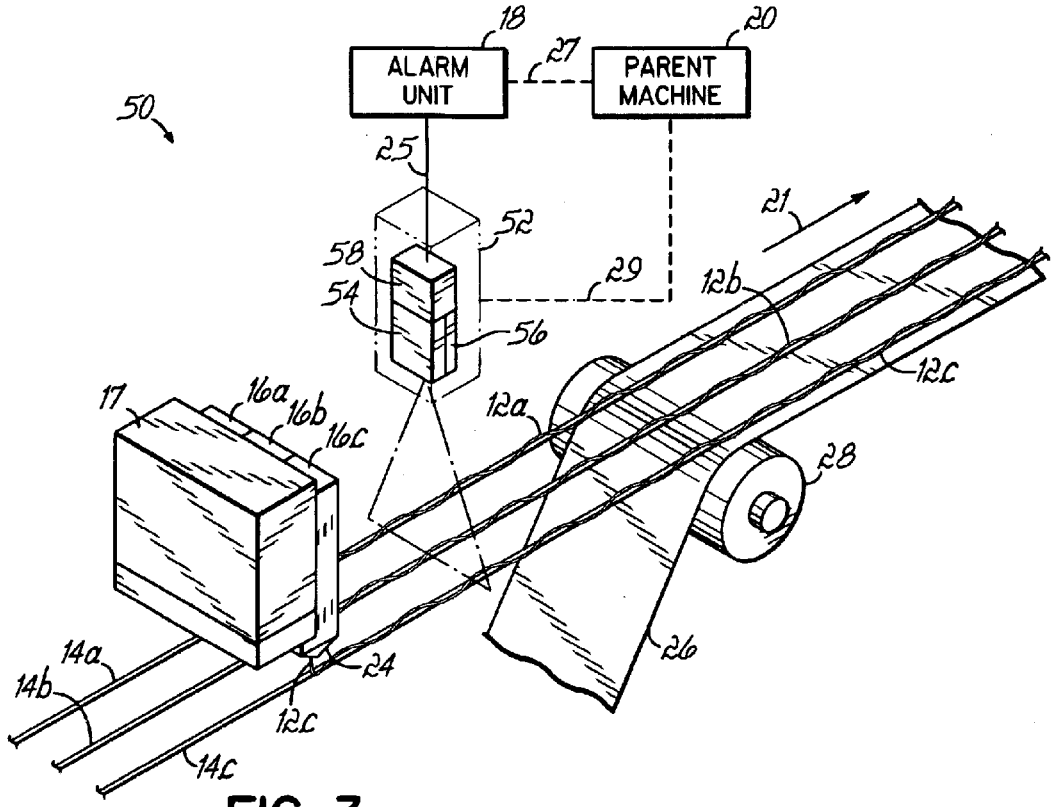
FIG. 3 is a schematic view of a coating application system according to the principles of the invention.

With reference to FIG. 3 and according to the principles of the. invention, a coating application system 50 may incorporate a detection unit, indicated generally by reference numeral 52, including a source or emitter 54 of electromagnetic radiation and a detector 56 capable of sensing electromagnetic radiation. The radiation emitted by emitter 54 and the radiation sensed by detector 56 are in at least one of the ultraviolet, visible, or infrared spectral regions of the electromagnetic spectrum.

The emitter 54 projects radiation toward the moving strands 14*a–c* each coated with a corresponding one of filaments 12*a–c*. The material forming each of the filaments 12*a–c* contains one or more fluorescing agents or substances, such as dyes or inks, that emit radiation or fluoresce in a spectral region of the electromagnetic spectrum, such as the visible region, when irradiated by radiation from emitter 54 in another spectral region of the electromagnetic spectrum, such as the ultraviolet region. The detector 56 is directed or oriented toward a location with a field-of-view of a reference area in space suitable for observing at least a portion of strands 14*a–c* before the strands 14*a–c* are contacted with the substrate 26 at nip roller 28. The intensity of the fluorescence detected by the detector 56 represents the coverage on each of the strands 14*a–c* provided by the corresponding patterns of filaments 12*a–c*.

The detection unit 52 further includes a controller 58 having suitable circuitry for defining one or more intensity limits or thresholds relating the intensity of the detected fluorescence and triggering an output fault signal if the intensity of the fluorescence falls outside of any of the thresholds. For example, the intensity threshold may be a lower intensity level which, if not exceeded, indicates an under-application of the amounts of viscous material in, or absence of, one or more of filaments 12*a–c*. Alternatively, the intensity threshold may be an upper intensity; level which, if exceeded, indicates an overapplication of the amounts of viscous material in filaments 12*a–c* to one or more of the strands 14*a–c*. The intensity thresholds represent reference values of a desired standard for the intensity of the detected fluorescence. The controller 58 may provide the fault signal to alarm unit 18 for a responsive action, as described herein with regard to detection unit 22, and/or may route a deactivation signal over line 29 directly to the parent machine 20, also as described herein with regard to detection unit 22.

Figure 4:
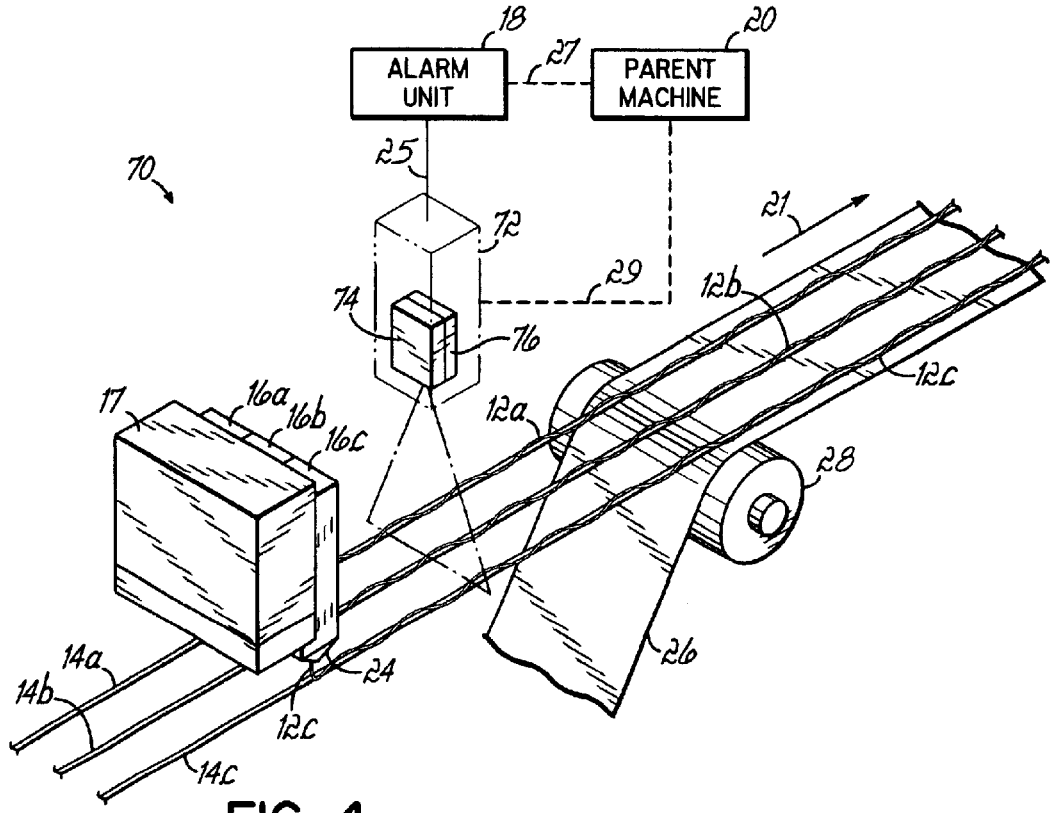
FIG. 4 is a schematic view of a coating application system according to the principles of the invention.

With reference to FIG. 4 and according to the principles of the invention, a coating application system 70 may include a detection unit 72 interfaced with alarm unit 18 or, in the alternative, with the parent machine 20. The coating application system 70 is configured such that the dispenser modules 16*a–c* dispense a heated viscous material. The infrared detection unit 72 includes an infrared sensor 74 and a controller 76 coupled in electrical communication with the infrared sensor 74. The infrared sensor 74 is directed or oriented with a field of view encompassing a reference area in space suitable for viewing at least a portion of strands 14*a–c* before the strands 14*a–c* are contacted with substrate 26. The infrared sensor 74 is capable of detecting thermal radiation or heat energy originating from the heated viscous material forming the filaments 12*a–c* and providing an output signal that is proportional to the intensity or amount of detected heat energy, typically in the infrared region of the electromagnetic spectrum. The heat emissions is portional to the surface area of filaments 12*a–c* visible to infrared sensors 74 and to the temperature of the filaments 12*a–c* and, therefore, is related to the pattern. Accordingly, the field-of-view of the infrared sensor 74 must be of a reference area in space proximate to the dispensing modules 16*a–c* so that the cooling of filaments 12*a–c* does not reduce the;radiated heat energy below the detection threshold of sensor 74. Typically, the reference area in space viewed by infrared sensor 74 must be within about two (2) meters of the dispensing module 16*a–c*, although the invention is not so limited.

The controller 76 incorporates circuitry appropriate to receive electrical signals from the infrared sensor 74 and process those signals for detecting a change in the amount of radiated heat energy, which might occur if one or more of the filaments 12*a–c* is either being misapplied or is absent. Accordingly, the circuitry of controller 76 compares the detected amount of radiated heat energy with one or more intensity limits or thresholds that represent reference values of a desired standard for the characteristic heat emission. The controller 76 triggers an output fault signal if the intensity of the heat emission falls outside of any of the thresholds. The controller 76 reacts to 10 a significant change in the amount of detected heat energy by either providing a fault signal via line 25 to alarm unit 18 or by providing a deactivation signal directly via line 29 to the parent machine 20, as described herein with regard to detection unit 22. The alarm unit 18 may generate a warning signal, such as an audible or visible warning signal, and, upon receiving the fault signal, may generate and route a deactivation signal over line 27 to the parent machine 20 to halt the production line, also as described herein with regard to detection unit 22. Detection units suitable for use in the invention include the PZ-V/M line of infrared sensors commercially available from Keyence Corporation (Osaka, Japan).

Figure 5:
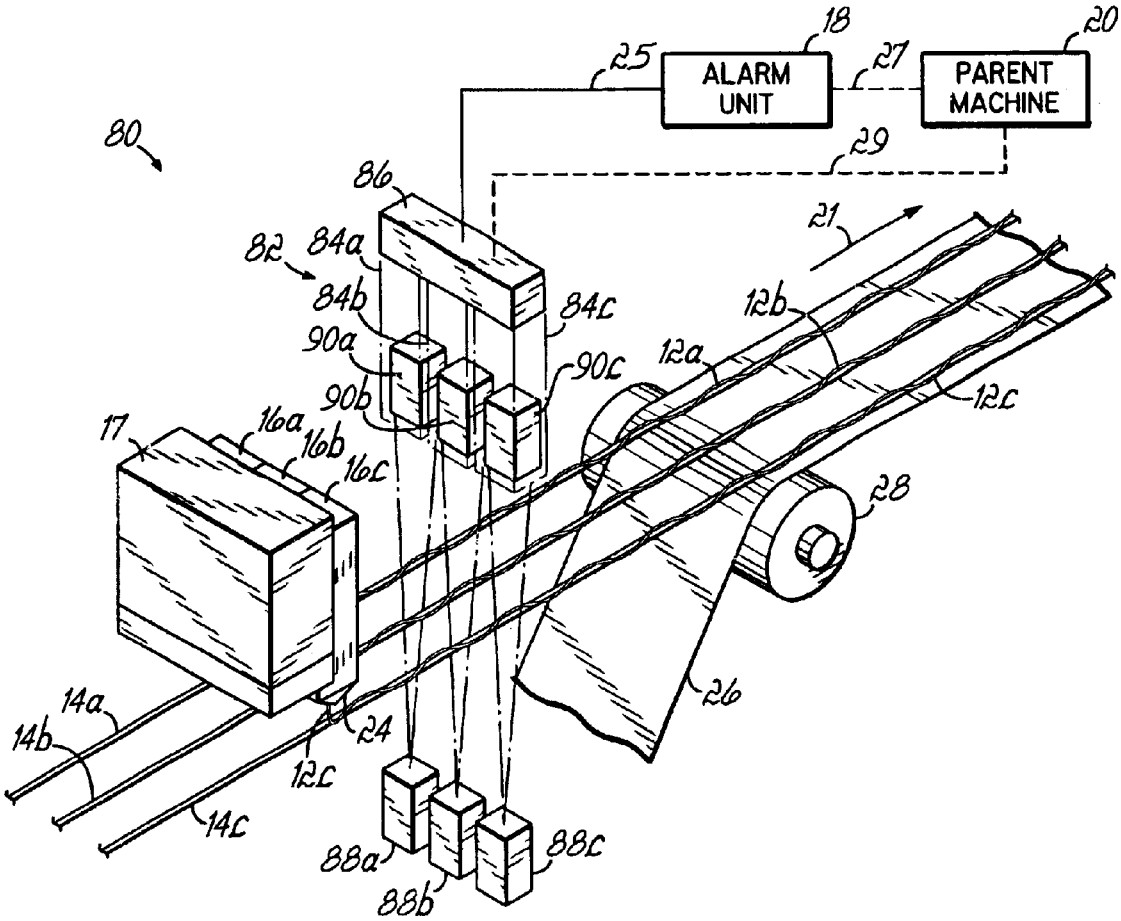
FIG. 5 is a schematic view of a coating application system according to the principles of the invention.

With reference to FIG. 5 and according to the principles of the invention, a coating application system 80 may include a detection unit or light curtain 82 containing one or more detectors and, in this embodiment, three detectors 84*a–c* and a controller 868 coupled electrically with the detectors 84*a–c*. The light curtain 82 is mounted so that the field of view of each of the 25 detectors 84*a–c* is of a reference area in space encompassing at least a portion of the corresponding one of strands 14*a–c* after the respective filaments 12*a–c* are applied and before the strands 14*a–c* are contacted with the substrate 26 at nip roller 28.

Detector 84*a* includes an emitter 88*a* and a receiver 90*a* positioned on an opposite side of strand 14*a* from the emitter 88*a*. Emitter 88*a* is any device, such as one or more light emitting diodes (LED's), capable of emitting radiation having an infrared and/or visible wavelength in the electromagnetic spectrum and receiver 90*a* is any device, such as a phototransistor or a photodiode, capable of sensing radiation of wavelength corresponding to that emitted by emitter 88*a*. Emitter 88*a* is aligned axially with the receiver 90*a* to establish a beam of radiation generally aimed from emitter 88*a* to receiver 90*a*. Although a substantial fraction of the radiation emitted from emitter 88*a* is received by receiver 90*a*, the emitter 88*a* and receiver 90*a* are positioned such that the filament 12*a* and strand 14*a* obstruct a portion of the radiation beam. As a result, a fraction of the radiation emitted by emitter 88*a* is not received by receiver 90*a* due to the presence of filament 12*a* and strand 14*a*.

A significant change in the detected transmitted intensity indicates improper application of filament 12*a* to strand 14*a*. In particular, a significant 20 increase in the detected intensity indicates that filament 12*a* is absent from strand 14*a*. Alternatively, the detected transmitted intensity may vary with time in correlation with any periodic features in the pattern characterizing the filament 12*a*. Similarly, detector 84*b* includes an emitter 88*b* and a receiver 90*b* monitoring filament 12*b* and strand 14*b* and detector 84*c* includes an emitter 88*c* and a receiver 90*c* monitoring filament 12*c* and stand 14*c*, each pair of which is arranged similar to emitter 88*a* and receiver 90*a* of detector 84*a* and each pair of which operates in a like manner for sensing changes in the detected transmitted intensity of the respective radiation beams. The intensity of the transmitted radiation relating to each of the strands 14*a–c* is converted by the corresponding one of receivers 90*a–c* into an electrical signal having a magnitude proportional to the transmitted intensity.

Controller 86 is electrically coupled with at least the receivers 90*a–c* and possibly with the emitters 88*a–c* as well. Controller 86 incorporates circuitry appropriate to receive electrical signals from the emitters 88*a–c* and process those electrical signals for detecting a change in the detected transmitted intensity. The detected intensity changes if the corresponding one of the filaments 12*a–c* is being properly applied to the corresponding one of the strands 14*a–c*. For example, because the transmitted intensity is proportional to the effective width or strand diameter of each strand 14*a–c* and filament 12*a–c* transverse to the filament travel direction 21, the absence of one of the filaments 12*a–c* increases the transmitted intensity detected by the corresponding one of the receivers 90*a–c* as less of the respective radiation beam is obstructed. As another example, repetitive features, such as repetitive features 40*a–l* in FIG. 2A, in a pattern characterizing the filaments 12*a–c* modulate the effective strand diameter and, as a result, operate to vary or modulate the transmitted intensity. The absence of a periodic variation in the transmitted intensity detected by one of the receivers 90*a–c* may indicate the absence or the misapplication of the corresponding one of the filaments 12*a–c*. It is apparent that sensitivity and reliability of the monitoring afforded by light curtain 82 may be increased by sensing changes in the transmitted intensity due to the repetitive features rather than sensing an absolute signal level.

If one of the filaments 12*a–c* is being improperly applied, the controller 86 may generate and send a fault signal to alarm unit 18. The alarm unit 18 may then provide an audible or visual alert, and/or may issue a deactivation signal via line 27 to parent machine 20, as described herein with regard to detection unit 22. It is contemplated that the controller 86 may route the deactivation signal directly to parent machine 20 over line 29 for action, as described herein with regard to detection unit 22.

In an alternative embodiment, the emitters 88*a–c* and receivers 90*a–c* may be positioned with an adjacent relationship on one side of strands 14*a–c*. In such a retroreflective sensing mode, each of the receivers 90*a–c* senses radiation reflected from the corresponding one of strands 14*a–c*. For example, a reduction in the reflected intensity may indicate the absence of one of the filaments 12*a–c* from the corresponding one of the strands 14*a–c*.

While the present invention has been illustrated by a description of various preferred embodiments and while these embodiments have been described in some detail, it is not the intention of the Applicants to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims, wherein

What is claimed is:

1. A method of applying viscous material onto a moving strand for securing the strand to a substrate, comprising:

moving the strand in a linear travel path;

dispensing a filament of a viscous material with transverse movement relative to the linear travel path;

applying the filament of the viscous material onto the moving strand to form a pattern characterized by a plurality of repetitive features formed upon contact of the filament with the moving strand;

sensing electromagnetic radiation originating from at least the viscous material;

determining a detected value representative of a characteristic of the plurality of repetitive features in the pattern from the sensed electromagnetic radiation;

comparing the detected value with a reference value representative of a desired standard for the characteristic; and outputting a signal in accordance with the comparison result.

2. The method of claim 1, further comprising:

providing an alarm to an observer upon receiving the signal.

3. The method of claim 2, wherein providing the alarm includes providing at least one of a visible indication and an audible indication to an observer.

4. The method of claim 2, wherein providing the alarm includes providing a deactivation signal to a parent machine for discontinuing the movement of the strand along the travel path.

5. The method of claim 1, wherein sensing electromagnetic radiation further comprises capturing an image of the strand, and the determining of the detected value further comprises processing the captured image.

6. The method of claim 5, wherein processing the captured images includes determining the volume of viscous material.

7. The method of claim 1, wherein sensing electromagnetic radiation further comprises detecting heat emission from the viscous material.

8. The method of claim 1, further comprising:

radiating the viscous material with electromagnetic radiation of a first wavelength, and wherein sensing electromagnetic radiation further comprises detecting fluorescence of a second wavelength different from the first wavelength emitted from the radiated viscous material.

9. The method of claim 1, wherein sensing electromagnetic radiation further comprises:

radiating the strand and the viscous material with incident electromagnetic radiation; and detecting the transmitted fraction of the incident electromagnetic radiation to determine the sensed electromagnetic radiation.

10. The method of claim 1, wherein comparing the detected and reference values further comprises sensing changes in the detected value of the characteristic relative to the reference value.

11. The method of claim 1, wherein applying the viscous material further comprises:

dispensing a single filament of the viscous material that defines the pattern upon contact with the moving strand.

12. The method of claim 11, wherein the characteristic is a frequency, and determining the detected value includes determining the frequency from the sensed electromagnetic radiation characterizing the pattern.

13. A method of applying viscous material onto a moving strand for securing the strand to a substrate, comprising:

moving the stand in a travel path;

applying a viscous material in a pattern onto the moving strand;

sensing electromagnetic radiation originating from at least the viscous material after the viscous material is applied to the strand and before the strand and the viscous material are applied to a substrate;

determining a detected value representative of a characteristic of the pattern from the sensed electromagnetic radiation;

comparing the detected value with a reference value representative of a desired standard for the characteristic;

outputting a signal in accordance with the comparison result; and applying the strand and the viscous material to the substrate.

14. The method of claim 13, further comprising:

providing an alarm to an observer upon receiving the signal.

15. The method of claim 14, wherein providing the alarm includes providing at least one of a visible indication and an audible indication to an observer.

16. The method of claim 14, wherein providing the alarm includes providing a deactivation signal to a parent machine for discontinuing the movement of the strand along the travel path.

17. The method of claim 13, wherein sensing electromagnetic radiation further comprises capturing an image of the strand, and the determining of the detected value further comprises processing the captured image.

18. The method of claim 17, wherein processing the captured image includes determining the volume of viscous material.

19. The method of claim 13, wherein sensing electromagnetic radiation further comprises detecting heat emission from the viscous material.

20. The method of claim 13, further comprising:

radiating the viscous material with electromagnetic radiation of a first wavelength, and wherein sensing electromagnetic radiation further comprises:

detecting fluorescence of a second wavelength different from the first wavelength emitted from the radiated viscous material.

21. The method of claim 13, wherein sensing electromagnetic radiation further comprises:

radiating the strand and the viscous material with incident electromagnetic radiation; and detecting the transmitted fraction of the incident electromagnetic radiation to determine the sensed electromagnetic radiation.

22. The method of claim 13, wherein comparing the detected and reference values further comprises sensing changes in the detected value of the characteristic relative to the reference value.

23. The method of claim 13, wherein applying the viscous material further comprises:

dispensing a single filament of the viscous material that defines the pattern upon contact with the moving strand.

24. The method of claim 23, wherein the characteristic is a frequency, and determining the detected value includes determining the frequency from the sensed electromagnetic radiation characterizing the pattern.

* * * * *

UNITED STATES PATENT AND TRADEMARK OFFICE

CERTIFICATE OF CORRECTION

PATENT NO. : 6,737,102 B1
DATED : May 18, 2004
INVENTOR(S) : Laurence Saidman et al.

It is certified that error appears in the above-identified patent and that said Letters Patent is hereby corrected as shown below:

Title Page,
Item [74], *Attorney, Agent or Firm,* change "Wodd" to -- Wood --.

Column 1,
Line 10, change "quality-of" to -- quality of --.

Column 7,
Line 36, change "serially" to -- serially --.
Line 42, change "as," to -- as --.
Line 59, change "berouted" to -- be routed --.
Line 62, change "the." to -- the --.

Column 8,
Line 30, change "intensity;" to -- intensity --.
Line 31, change "overapplication" to -- over-application --.
Line 58, change "emissions" to -- emission --.
Line 64, change "the;radiated" to -- the radiated --.

Column 9,
Line 12, delete "10".
Line 30, change "868" to -- 86 --.
Line 32, delete "25".

Column 11,
Line 30, change "images" to -- image --.
Line 63, change "stand" to -- strand --.

Signed and Sealed this

Third Day of May, 2005

JON W. DUDAS
*Director of the United States Patent and Trademark Office*